United States Patent [19]

Sinclair et al.

[11] 4,451,036

[45] May 29, 1984

[54] BATTING PRACTICE DEVICE

[76] Inventors: Bernard J. Sinclair, 7211 SW. 11th St., Des Moines, Iowa 50315; Dominic R. Mauro, 1629 E. Virginia St., Des Moines, Iowa 50320

[21] Appl. No.: 279,720

[22] Filed: Jul. 2, 1981

[51] Int. Cl.[3] ..... A63B 69/40

[52] U.S. Cl. ..... 273/26 R

[58] Field of Search ..... 273/26 R, 29 A, 191 A, 273/35 R, 183 R, 183 E, 186 R, 186 C, 191 R; 272/123; 46/132 WL

[56] References Cited

U.S. PATENT DOCUMENTS

| | | | |
|---|---|---|---|
| 1,567,530 | 4/1924 | MacNaughton et al. | 273/191 A |
| 1,881,384 | 12/1930 | Albera | 273/26 R |
| 2,443,131 | 6/1948 | Fessler | 273/26 R |
| 2,653,025 | 9/1953 | Zega | 273/191 A |
| 2,985,452 | 5/1961 | Trippet | 273/26 R |
| 3,042,401 | 7/1962 | Denegre | 273/26 E |
| 3,305,234 | 2/1967 | Cline et al. | 272/123 |
| 3,367,655 | 2/1968 | Navran | 273/26 E |
| 3,375,010 | 3/1968 | Panza | 273/186 C |
| 3,386,733 | 6/1968 | Russo et al. | 273/26 R |
| 3,472,026 | 10/1969 | Cooper | 273/26 R |
| 3,550,938 | 12/1970 | Cunningham, Jr. | 273/26 R |
| 3,572,720 | 3/1971 | Berg | 273/186 C |
| 3,741,550 | 6/1973 | Landures | 273/186 R |
| 3,904,199 | 9/1975 | Burchett | 273/26 R |
| 3,937,464 | 2/1976 | Zalewski | 273/26 R |
| 3,940,131 | 2/1976 | Claire, Jr. | 273/26 R |
| 3,948,517 | 4/1976 | Feller | 273/29 A |
| 3,997,158 | 12/1976 | Britton | 273/26 A |

*Primary Examiner*—Richard C. Pinkham
*Assistant Examiner*—T. Brown
*Attorney, Agent, or Firm*—Zarley, McKee, Thomte, Voorhees & Sease

[57] ABSTRACT

A batting practice device comprising a support post with a target apparatus mounted on the upper portion thereof. The target apparatus is comprised of an upper portion and a lower portion which are in spaced apart condition with an open horizontally disposed strike zone between. The upper and lower portions each comprise an arm that extends outwardly from the post. A guide frame is mounted on the outer end of the arm. A plurality of flexible members are secured to the guide frame and extend towards and define the strike zone. A plurality of flexible elements extend into the strike zone to provide resistance to a swung bat passing through the strike zone. The side portions of the guide frames are disposed at an angle with respect to the strike zone and are padded with a resilient material. A shock absorber is mounted in the length of each of the arms.

2 Claims, 7 Drawing Figures

BATTING PRACTICE DEVICE

BACKGROUND OF THE INVENTION

The batting practice devices of the prior art are difficult to adjust and ordinarily do not provide a realistic batting practice environment. They are not readily adjustable for batters of different heights and often cannot be used by both left and right-handed batters.

SUMMARY OF THE INVENTION

The device of this invention provides a supporting post with a target portion on the upper end thereof comprised of upper and lower portions. The upper and lower portions consist of a laterally extending arm that is supported by the post with a shock absorber means imposed in the length of the arm. Guide means are provided on the outer ends of the arms, a plurality of flexible members extend downwardly and upwardly, respectively, from the upper and lower guide means. The free ends of the flexible members define a horizontally disposed strike zone. Flexible elements extend into the strike zone to provide resilient resistance to a bat passing through the strike zone. Each of the upper and lower portions are adjustably mounted on the supporting post.

The device of this invention permits the overall height of the strike zone to be raised and lowered to accommodate batters of different stature. Further, the vertical height of the strike zone can be selectively varied, depending on the precision of the practicing exercise.

Most importantly, flexible elements extend into the strike zone to provide resilient resistance to a bat passing therethrough so as to simulate the impact of the bat with a ball whereby the batter can experience in the practice swing the follow through that is needed to become a successful hitter.

The cam lock on the upper and lower portions of the target means permit the device to be easily and quickly adjusted as described heretofore.

Further, the device of this invention is well padded with resilient material so as to protect both the device and the batter in the event that the bat does not perfectly enter the strike zone.

These and other objectives will be apparent to those skilled in the art.

DESCRIPTION OF THE PREFERRED EMBODIMENT

Figure 1:
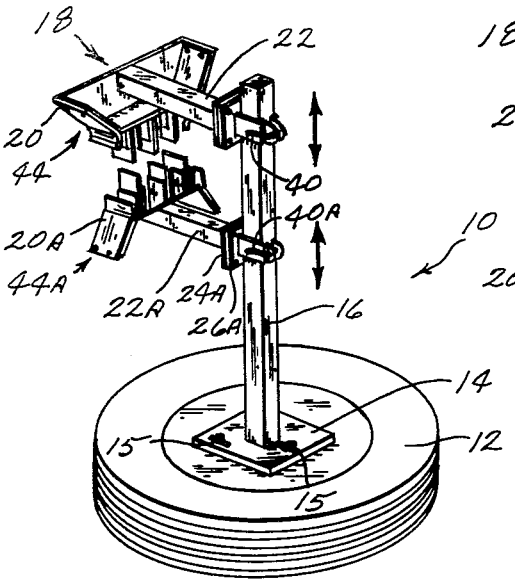
FIG. 1 is a perspective view of the device of this invention.
Figure 2:
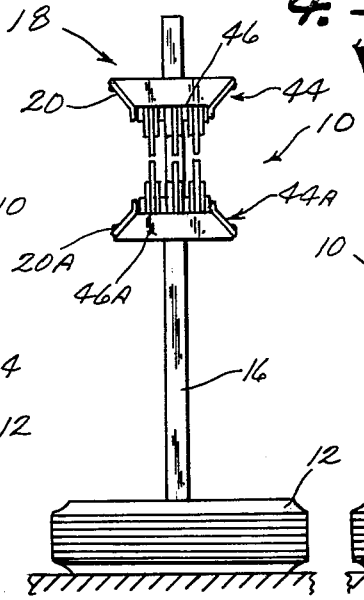
FIG. 2 is an elevational view as seen from the left-hand side of FIG. 1.
Figure 3:
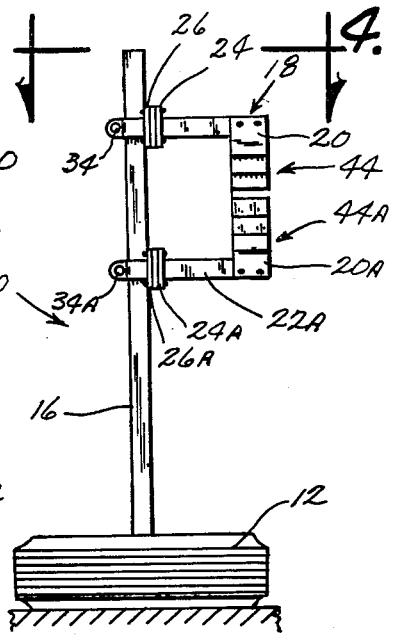
FIG. 3 is an elevational view of the device of this invention as seen from the left-hand side of FIG. 2.

The numeral 10 generally designates the batting practice device of this invention which is supported on a base 12. A base plate 14 is secured to base 12 by bolts 15 or the like. A post 16 is welded or otherwise secured at its lower end to base plate 14.

A target means 18 is secured to the upper end of post 16 and is comprised generally of an upper portion 20 and a lower portion 20A. The upper portion 20 and lower portion 20A are substantially identical. The upper portion will be described hereafter, it being understood that corresponding parts of the lower portion will have the same identifying numerals with the letter "A" appearing thereafter.

Arm 22 is disposed in a horizontal position and has plate 24 (FIG. 4) welded or otherwise secured to the end thereof closest to post 16. Plate 26 is substantially identical to plate 24 and is disposed opposite thereof with rubber pad 28 positioned between the two plates. Bolts 29 serve to secure the plates 26 and 28 together to compress rubber pad 28 therebetween. Rubber pad serves as a shock absorbing means between arm 22 and posts 16 as will be described hereafter.

Figure 4:
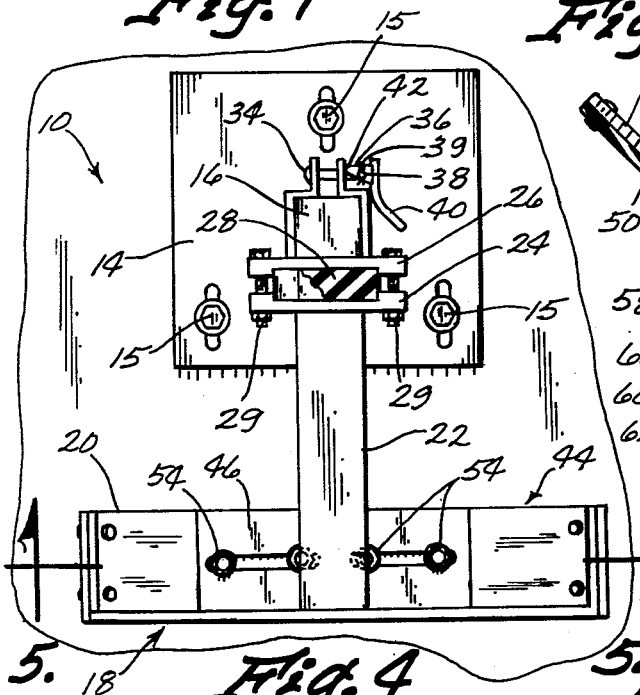
FIG. 4 is a plan view of the device of this invention shown at an enlarged scale as seen on line 4—4 of FIG. 3.

Oppositely disposed brackets 30 are secured to plate 26 as shown in FIG. 4. Each of the brackets 30 partially embrace posts 16 and terminate in outwardly extending flanges 32.

Figure 7:
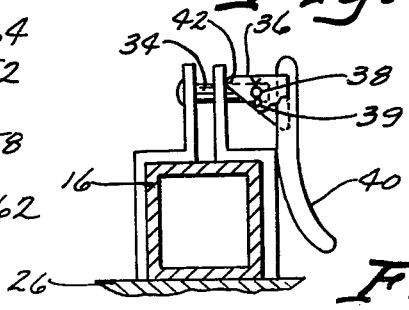
FIG. 7 is a detailed view of the cam lock mechanism whereby the device can be selectively adjusted.

As best shown in FIG. 7, a bolt 34 extends through registering apertures in flanges 32. A pair of spaced apart triangular plates 36 are mounted on opposite sides of bolt 34 and are pivotally secured to bolt 34 by pin 38. A conventional cotter key 39 holds pin 38 in place.

A handle 40 is welded between triangular plates 36. The tip 42 of plates 36 binds against flanges 32 when the handle 40 is in the position shown in FIG. 7. When the handle 40 is rotated in a counter-clockwise direction as viewed in FIG. 7 the tip 42 rotates out of engagement with flange 32 whereupon the flanges and brackets move to a relaxed position on post 16 whereupon slidable adjustment with respect to the post is permitted. When handle 40 is moved back into the position of FIG. 7, the brackets 30 again rigidly grip the post to rigidly hold the brackets in position on the post.

An upper guide frame 44 is rigidly secured to the outer end of arm 22. Guide frame 44 is comprised of a horizontal central portion 46 and diagonally disposed side portions 48. Rubber pads 50 are bolted or otherwise secured to the side portions 48 to protect the side portions in the event that they are hit by a bat.

Figure 5:
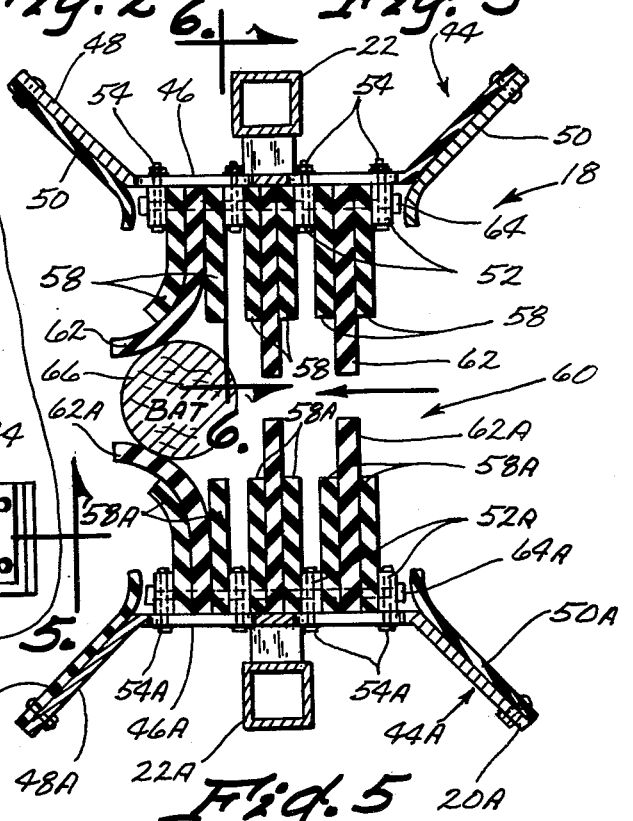
FIG. 5 is a sectional view taken on line 5—5 of FIG. 4.
Figure 6:
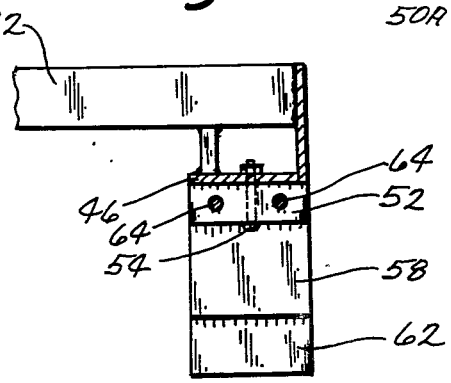
FIG. 6 is a partial sectional view taken on line 6—6 of FIG. 5.

Spacer elements 52 are positioned on the horizontal central portion 46 as best shown in FIG. 5. Vertically disposed bolts 54 extend through the spacer elements 52 to secure the spacer elements to the central portion 46.

Flexible strap members 56 are positioned in spaced apart condition between the spacer elements 52. The ends 58 of the flexible members 56 define a horizontally disposed strike zone 60.

Flexible elements 62 are positioned between flexible members 56. The length of flexible elements 62 is greater than the length of the members 56 so that the outer ends of the elements 62 protrude into the strike zone 60. A horizontal bolt 64 extends through the spacer elements 52, the flexible members 56, and the flexible elements 62 to secure these components together.

The handles 40 are actuated in the manner previously described to position the upper guide frame 44 and the lower guide frame 44A on the post 16 at a height to suit the stature of the batter who is to use the device. Normally, these components would be set at a height so as to permit the batter to make a normal horizontal swing through the strike zone 60 with a bat 66. The handle 40 on each of the upper and lower guide frames can also be used to create variations in the vertical height of the strike zone.

It should be noted that either a right-handed or left-handed batter can utilize the device of this invention by merely assuming a position on either one side or the other of the protruding target 18.

As the bat is swung through the strike zone 16, the bat encounters the protruding flexible elements 62 which extend into the strike zone. This phenomenon simulates the contact between the bat and a pitched ball and forces the batter to follow through with his forward arm (the left arm of a right-handed batter, and the right arm of a left-handed batter) as is required in a desirable batting technique.

If the bat does not perfectly encounter the strike zone 60, the flexible members 56 and 56A, as well as the rubber pads 50 and 50A protect both the device, the bat and the batter from any adverse affects.

It is seen that the device of this invention will provide a realistic batting environment for the practicing batter. It is easily adjustable to batters of different stature and different expertise, and will accommodate easily both right and left-handed batters.

From the foregoing, it is seen that the device of this invention will achieve at least its stated objectives.

We claim:

1. A batting practice device, comprising, a vertically disposed support post, a first clamp means selectively vertically movably mounted on said post, a first arm resiliently secured to said first clamp means and extending horizontally outwardly therefrom, a first frame means at the outer end of said first arm and having a bottom portion with side portions extending upwardly and outwardly therefrom, a plurality of vertically disposed resilient members secured to said first frame means extending downwardly from the bottom portion thereof, a second clamp means selectively vertically movably mounted on said post below said first clamp means, a second arm resiliently secured to said second clamp means and extending horizontally outwardly therefrom, a second frame means at the outer end of said second arm and having a top portion with side portions extending downwardly and outwardly therefrom, a plurality of vertically disposed resilient members secured to said second frame means and extending upwardly from the top portion thereof, the resilient members on each of said first and second frame means comprising a plurality of groups of flexible members, each of said groups of flexible members including a middle flexible member having outer flexible members positioned on opposite sides thereof with the middle flexible member having a length greater than the outer flexible members, said groups of said flexible members on said first and second frame means defining a strike zone therebetween, said first and second frame means being vertically adjustable movably mounted with respect to said support post to permit the height of the strike zone to be varied, said first and second frame means being movable towards and away from each other to permit the flexible members on said first and second frame means to be moved towards one another or away fron one another.

2. The batting practice device of claim 1 wherein a cushion means is provided on the side portions of both of said first and second frame means.

* * * * *